US012668753B2

(12) United States Patent
Sato

(10) Patent No.: US 12,668,753 B2
(45) Date of Patent: Jun. 30, 2026

(54) BIOLUBRICANTS FOR REFRIGERATION SYSTEMS AND OTHER APPLICATIONS

(71) Applicant: NUOL Green Chemistry LLC, Little Falls, MN (US)

(72) Inventor: Setsuo Sato, Piracicaba (BR)

(73) Assignee: NUOL Green Chemistry LLC, Little Falls, MN (US)

( * ) Notice: Subject to any disclaimer, the term of this patent is extended or adjusted under 35 U.S.C. 154(b) by 0 days.

(21) Appl. No.: 18/596,093

(22) Filed: Mar. 5, 2024

(65) Prior Publication Data

US 2025/0277158 A1 Sep. 4, 2025

(30) Foreign Application Priority Data

Mar. 1, 2024 (BR) ..... 1020240042522

(51) Int. Cl.
*C10M 101/04* (2006.01)
*C10N 20/00* (2006.01)
*C10N 40/30* (2006.01)

(52) U.S. Cl.
CPC ..... *C10M 101/04* (2013.01); *C10N 2020/081* (2020.05); *C10N 2040/30* (2013.01)

(58) Field of Classification Search
CPC ..... C10M 101/04; C10N 2020/081; C10N 2040/30
See application file for complete search history.

(56) References Cited

U.S. PATENT DOCUMENTS 4,440,660 A * 4/1984 van Rijs ..... C07C 69/30 508/485
6,361,711 B1 * 3/2002 Abe ..... C10M 169/041 508/474
6,664,216 B1 * 12/2003 Lakes ..... C10M 133/16 508/496
8,486,871 B2 7/2013 Nagao et al.
2005/0119137 A1 * 6/2005 Choo ..... C10M 105/34 554/174
2017/0130161 A1 * 5/2017 Vettel ..... C10M 169/04
2020/0017795 A1 * 1/2020 Saito ..... C10M 111/04

FOREIGN PATENT DOCUMENTS

BR PI0905200 A2 * 3/2011
KR 20220101428 A * 7/2022
WO 2010085545 A1 7/2010

OTHER PUBLICATIONS

English-language machine translation of BR PI0905200A2 (Year: 2011).*
English-language machine translation of KR 20220101428 A (Year: 2022).*

* cited by examiner

*Primary Examiner* — James C Goloboy
(74) *Attorney, Agent, or Firm* — Sterne, Kessler, Goldstein & Fox P.L.L.C.

(57) ABSTRACT

The development of biolubricants from vegetable oils, more specifically refers to capric, caprylic, lauric, myristic, palmitic, stearic, oleic, linoleic, linolenic, ricinoleic, isooleic, isostearic, undecylenic fatty acids whose applications are for compressors in refrigerators, freezers, air conditioners, industrial compressors and as lubricants for the automotive line is provided. Such products are used in refrigeration compressors, more specifically in refrigerators and air conditioners, industrial compressors and lubricants for the small and large automotive sector. Due to the use of 90% renewable raw materials, the products are biodegradable, non-toxic and safe to be handled. These products, after use as lubricants, can be discarded due to their biodegradability or recovered to be used in other less rigid applications, such as for the production of polyester resins, polyols for the production of polyurethanes, or production of plasticizers for PVC, paints and varnishes.

7 Claims, No Drawings

BIOLUBRICANTS FOR REFRIGERATION SYSTEMS AND OTHER APPLICATIONS

The invention is based on the development of biolubricants from vegetable oils for refrigeration systems, more specifically for refrigerator and air conditioner compressors. Due to the long lifespan of these types of domestic equipment, acceptance and approval test standards for this class of lubricant are extremely rigorous and can exceed 3,000 hours.

The products currently used are all of petrochemical origin and most are not biodegradable, which makes it difficult to dispose of these materials after use. Chemically, they are polyol esters produced mainly from 2-ethyl hexoic acid and polyols such as pentaerythritol, trimethylolpropane and neopentyl glycol.

These are products with excellent performance and high cost. They are normally low viscosity and low freezing point products.

In most countries, the disposal after use of these products of petrochemical origin is prohibited, which creates a major problem and cost.

One of the requirements is that they should be soluble in most refrigeration gases. Old refrigerators used freon gas, which is very aggressive to the ozone layer. Currently, fluorocarbon-based gases of different compositions are used, but these types of gases attack the ozone layer and there is a tendency to use more environmentally friendly gases.

To be a good refrigerant, the substance must have the following characteristics:

Liquefy at moderate pressures;
Evaporate at pressures above atmospheric pressure;
Have a small specific volume;
Have a high latent heat of vaporization;
Be chemically stable;
Not be corrosive;
Not be flammable;
Non-toxic;
Allow easy leak location;
Do not attack the lubricating oil or cause any negative effect on other components of the refrigeration cycle; and
Do not attack or deteriorate food in case of leakage.

Most known refrigerant gases:

Ammonia (R-717): despite being toxic and under certain conditions, flammable and explosive, it is widely used in large installations, given its thermal capacity. It has the greatest cooling effect among the main refrigerants. Corrosive to copper and brass—all ammonia refrigeration equipment is made of steel. It is not miscible with oil and attacks food. With water it forms alkali, which has undesirable effects on copper, brass and aluminum. Its leak is easily located using soap suds or burning sulfur.

R 11: it was widely used as a solvent for cleaning the components of a refrigeration system. Nowadays, it tends to fall into disuse and is largely replaced by H 141.

R 12: it is still widely used in domestic refrigeration. It is non-toxic, non-flammable, non-corrosive and non-explosive. Highly stable. Mix with lubricating oil. Its refrigerant effect is relatively low compared to other refrigerants. It tends to be replaced by R 134 a.

R 22: widely used in air conditioners. It requires low volumetric displacement, which allows for smaller equipment sizes. Due to its tendency to high discharge temperatures, its suction temperature must be kept as low as possible, especially with hermetic compressors. The condensers must be very clean to facilitate air circulation; otherwise, its pressure quickly rises to values that are harmful to the compressor. It mixes with the oil where it normally separates in the evaporator. It has greater thermal capacity than R 12, as it only requires 60% of the displacement for the same refrigerating capacity. It also has a greater capacity to absorb water than R 12, which is the reason that a system with R 22 rarely suffers from clogging due to moisture freezing. At the same time, this is a disadvantage, since the residual moisture will circulate freely in the system, oxidizing the internal parts and the oil.

Five gases that destroy the ozone layer reached record levels around the world in 2020, even 3 decades after the signing of the international agreement to gradually eliminate the use and dispersion of substances of this type.

According to a study published in the scientific journal "Nature Geoscience", the amount of these five chlorofluorocarbons (CFCs) in the atmosphere increased significantly between 2010 and 2020, mainly because of loopholes that are not defined in the legal framework, the so-called Montreal Protocol, signed even by Brazil.

During this period, scientists identified the following percentage increases in the atmospheric concentration of these compounds:

4% in the case of CFC-115m, going from 8.38 ppt in 2010 to 8.71 ppt in 2020;
9% in the case of CFC-114a, going from 1.03 ppt in 2010 to 1.13 ppt in 2020;
9% in the case of CFC-13, going from 3.04 ppt in 2010 to 3.31 ppt in 2020;
19% in the case of CFC-112a, going from 0.066 ppt in 2010 to 0.078 ppt in 2020;
and 141% in the case of CFC-113a, going from 0.43 ppt in 2010 to 1.02 ppt in 2020;
ppt is a concentration measurement widely used to estimate the amount of polluting gases in the air, such as CFCs. In this case, one part per trillion (ppt) means that there is one part of that substance in each trillion of parts of air.

Although scientists emphasize that the current impact of the emission of these five CFCs is considered low for the ozone layer, a continuous increase in these concentrations could imply some damage, and thus compromise all the progress brought by the Protocol, which is fundamental to avoid further warming of the planet by the end of the century.

Earlier this year, the UN even announced that if current CFC reduction policies remain in force, the layer that protects us from the harmful effects of ultraviolet rays could completely recover within 4 decades.

This is important because its destruction would profoundly affect life on our planet, affecting everything from the health of human beings to even the development of plants and other living beings.

Therefore, there is a tendency to use chlorine-free refrigerant gases of the type 417 A, 413 A.

Status Quo

U.S. Pat. No. 8,486,871B2 describes the important role in the useful life of equipment whose main function is to reduce friction and wear, thereby maintaining integrity and reducing maintenance costs. Furthermore, when correctly applied, it minimizes damage caused by high temperatures, corrosion and friction. In the opposite condition, at low temperatures, they allow liquids to flow through smallthickness pipes, preventing them from clogging, as is the case with refrigerator and air-conditioner compressors.

Patent WO 2010/085545 A1 deals with the production of petrochemical-based polyol esters having as monocarboxylic acid acetic acid, propionic acid, butanoic acid, pentanoic acid, hexanoic acid, heptanoic acid, octanoic acid, nonanoic acid, acid decanoic acid, undecanoic acid, dodecanoic acid, tridecanoic acid, tetradecanoic acid, pentadecanoic acid, 3-methylbutanoic acid, 2-methylbutanoic acid, 2-ethylhexanoic acid, 2,4-dimethylpentanoic acid, 3,3,5-trimethylhexanoic acid and benzoic acid. The polyols used are mainly neopentyl glycol, trimethylolpropane, pentaerythritol, polypropylene glycol, polyalkylene glycols.

The main applications of lubricants are for industrial and domestic compressors (refrigerators and air conditioner), vehicle engines, wind farm engines whose demand is increasing in volume and performance. The main function of reducing friction without causing an increase in energy and mainly reducing environmental impacts.

DESCRIPTION OF THE INVENTION

Mainly aiming to reduce the environmental impacts of lubricants, several types of biolubricants were developed with viscosity ranging from 7 centistokes to 68 centistokes for use in refrigeration compressors.

All formulations developed have a content of 90% to 100% material of plant origin.

The precursor materials of plant origin for the products were palm kernel oil, palm oil, soybean oil, castor oil, corn oil, canola oil, sunflower oil, peanut oil and their respective fatty acids.

The remainder of the composition, whose participation is less than 10%, are polyols such as pentaerythritol, neopentyl glycol, trimethylolpropane, propylene glycol, glycerin, polyglycerin, isoamyl alcohol from fusel oil.

The synthesized molecules were designed to obtain products that provide wetting, friction reduction, spreadability, homogeneous film formation, coating, anticorrosive power, and chemical stability. Starting from the fundamentals that long chains provide adhesion to physical surfaces as such metals, polymers, wood, unsaturations are polar sites that reduce freezing point and affinity on polar surfaces as well as ester bonds.

All of these products were produced in multipurpose reactors using classical esterification and transesterification techniques.

Details of Formulations According to Viscosities

1—Biolubricant Iso 7 Cst:

This group of lubricants was produced with neopentyl glycol and fatty acids from palm kernel oil, isooleic fatty acid obtained through the isomerization of soy fatty acid or TOFA, with molar ratios of 1.0 of neopentyl glycol and 2.1 to 3.0 moles of palm kernel fatty acid or isooleic fatty acid.

Formulations containing 1.0 moles of neopentyl glycol and 1.9 to 2.3 moles of soy fatty acid were also used to obtain the same viscosity and freezing point results.

2—Biolubricant Iso 10 Cst:

This group of lubricants were produced with neopentyl glycol and lauric fatty acids from palm kernel oil, with molar ratios of 1.0 of neopentyl glycol and 2.0 to 2.2 moles of lauric fatty acid.

To obtain the same characteristics, formulations containing 80 to 90% of ISO 7 and 10 to 20% of ISO 46 products were produced and successfully tested.

3—Biolubricant Iso 22 Cst:

This family of products was formulated with 70% to 75% of ISO 7 and 25% to 30% of ISO 46 products. With this strategy we obtain products within specifications with excellent lubricity properties.

4—Biolubricant Iso 32 Cst:

This family was developed specifically for use in air conditioner compressors. This group of products was formulated with 60% to 70% ISO 7 and 30% to 40% ISO 46 products. With these blends we obtain products within the specifications and quality standards required by this market segment.

5—Biolubricant Iso 46 Cst:

This product group was developed for use in medium and large industrial compressors and to be formulated with other lower viscosity products. This group was fundamental in the formulation strategy due to its characteristics.

It was produced by the reaction of trimethylolpropane and palm oil fatty acid, palm olein oleic acid, animal oleic acid, tall oil fatty acid (TOFA), corn fatty acid, sunflower fatty acid, canola fatty acid, peanut fatty acid, soy fatty acid, using 1 mol of trimethylolpropane and 2.95 mol to 3.2 mol of the previously mentioned fatty acids.

In this sense, the following are described:

1. Biolubricants that can be: ISO 7 cst biolubricant, ISO 10 cst biolubricant, ISO 22 cst biolubricant, ISO 32 cst biolubricant and ISO 46 cst biolubricant.
2. Biolubricants, in accordance with item 1, in which 90% of raw materials of renewable origin are manufactured, biodegradable, non-toxic and safe to be handled.
3. Biolubricants, in accordance with item 1 or 2, in which after use as lubricants they can be discarded due to their biodegradability or recovered to be used in other less rigid applications, for the production of polyester resins, polyols for the production of polyurethanes, or production of plasticizers for PVC, paints and varnishes.
4. Use of fatty materials of natural origin in the preparation of biolubricants as defined in items 1 to 3.
5. Use, according to item 4, in which the fatty acids are capric, caprylic, lauric, myristic, palmitic, stearic, oleic, linoleic, linolenic, ricinoleic, isooleic, isostearic, undecylenic, epoxidized ricinoleic and having the epoxy rings open with methanol, ethanol, glycols and glycerin.
6. Use of biolubricants from items 1 to 3 in refrigeration compressors, more specifically in refrigerators and air conditioners, industrial compressors and lubricants for the small and large automotive sector.

The invention claimed is:

1. A formulation produced from neopentyl glycol and isooleic acid, wherein the molar ratios are 1.0 mole of neopentyl glycol and 2.1 to 3.0 moles of isooleic acid.

2. The formulation of claim 1 having ISO VG 7.

3. A blended formulation comprising:

(i) 70% to 75 wt % of a first formulation produced from neopentyl glycol and fatty acids, wherein the fatty acids comprise isooleic acid, isostearic acid, or undecylenic acid, or a combination thereof; and (ii) 25 wt % to 30 wt % of a second formulation comprising trimethylolpropane fatty acid triesters, wherein the trimethylolpropane fatty acid triesters are produced from trimethylolpropane and capric acid, caprylic acid, lauric acid, myristic acid, palmitic acid, stearic acid, oleic acid, linoleic acid, linolenic acid, isooleic acid, isostearic acid, or undecylenic acid, or a combination thereof, wherein the blended formulation has ISO VG 22.

4. The blended formulation of claim 3, wherein the first formulation is produced from 1.0 mole of neopentyl glycol and 2.1 to 3.0 moles of isooleic acid.

5. A blended formulation comprising:

(i) 60 wt % to 70 wt % of a first formulation produced from neopentyl glycol and fatty acids, wherein the fatty acids comprise isooleic acid, isostearic acid, or undecylenic acid, or a combination thereof; and (ii) 30 wt % to 40 wt % of a second formulation comprising trimethylolpropane fatty acid triesters, wherein the trimethylolpropane fatty acid triesters are produced from trimethylolpropane and capric acid, caprylic acid, lauric acid, myristic acid, palmitic acid, stearic acid, oleic acid, linoleic acid, linolenic acid, isooleic acid, isostearic acid, or undecylenic acid, or a combination thereof, wherein the blended formulation has ISO VG 32.

6. The blended formulation of claim 5, wherein the first formulation is produced from 1.0 mole of neopentyl glycol and 2.1 to 3.0 moles of isooleic acid.

7. A blended formulation comprising:

(i) 80 wt % to 90 wt % of a first formulation produced from neopentyl glycol and fatty acids, wherein the fatty acids comprise isooleic acid, isostearic acid, or undecylenic acid, or a combination thereof; and (ii) 10 wt % to 20 wt % of a second formulation comprising trimethylolpropane fatty acid triesters, wherein the trimethylolpropane fatty acid triesters are produced from trimethylolpropane and capric acid, caprylic acid, lauric acid, myristic acid, palmitic acid, stearic acid, oleic acid, linoleic acid, linolenic acid, isooleic acid, isostearic acid, or undecylenic acid, or a combination thereof, wherein the blended formulation has ISO VG 10.

* * * * *